US008136469B2

(12) United States Patent
Rosenberger

(10) Patent No.: US 8,136,469 B2
(45) Date of Patent: Mar. 20, 2012

(54) DIVER TOW AND UNDERWATER BREATHING APPARATUS

(76) Inventor: Timothy J. Rosenberger, Pompano Beach, FL (US)

( * ) Notice: Subject to any disclaimer, the term of this patent is extended or adjusted under 35 U.S.C. 154(b) by 715 days.

(21) Appl. No.: 12/156,987

(22) Filed: Jun. 6, 2008

(65) Prior Publication Data

US 2009/0000617 A1 Jan. 1, 2009

Related U.S. Application Data

(60) Provisional application No. 60/942,852, filed on Jun. 8, 2007.

(51) Int. Cl.
*B63C 11/46* (2006.01)

(52) U.S. Cl. ..... 114/315

(58) Field of Classification Search ..... 114/242, 114/315; 440/6, 49, 53, 57, 66, 71, 72, 75, 440/76, 78, 84; 417/571
See application file for complete search history.

(56) References Cited

U.S. PATENT DOCUMENTS

| | | | | |
|---|---|---|---|---|
| 1,579,529 | A * | 4/1926 | Haschke | 440/6 |
| 3,630,165 | A * | 12/1971 | Bottger | 114/315 |
| 3,791,327 | A * | 2/1974 | Deveney | 114/315 |
| 4,348,976 | A | 9/1982 | Gilbert | |
| 4,602,589 | A * | 7/1986 | Quinata | 114/315 |
| 4,832,013 | A | 5/1989 | Hartdorn | |
| 5,082,464 | A * | 1/1992 | Clink | 440/6 |
| 5,323,727 | A * | 6/1994 | Heaton | 114/315 |
| 5,327,849 | A * | 7/1994 | Miller | 114/315 |
| 5,924,416 | A | 7/1999 | Miller | |
| 7,159,528 | B1 | 1/2007 | Hilliker | |

* cited by examiner

*Primary Examiner* — Daniel Venne
(74) *Attorney, Agent, or Firm* — James Ray & Assoc

(57) ABSTRACT

A floating apparatus operable for towing at least one diver and providing compressed air thereto for underwater breathing includes a water impermeable and buoyant hollow housing that floats on a surface of a body of water. A power source is mounted on the housing and a compressor is provided and is operable by the power source for generating the compressed air. A propulsion generating assembly is operable by at least one of the power source and the compressor for generating a propulsion force capable of moving the apparatus and towing such at least one diver. A control device is operatively coupled to the propulsion generating assembly and is manually operable by the at least one diver for generating the propulsion force simultaneously with generation of the compressed air.

8 Claims, 9 Drawing Sheets

DIVER TOW AND UNDERWATER BREATHING APPARATUS

CROSS-REFERENCE TO RELATED APPLICATIONS

This application is related to and claims priority from Provisional Patent Application Ser. No. 60/942,852 filed on Jun. 8, 2007.

FIELD OF THE INVENTION

The present invention relates, in general, to diving apparatus and, more particularly, this invention relates to a powered floating apparatus capable of simultaneously towing the diver and providing compressed air for underwater breathing.

BACKGROUND OF THE INVENTION

As is generally well known, portable floating devices have been utilized for supplying pressurized air to a submerged diver in order to prolong underwater stay without requiring the diver to return to the surface for air. U.S. Pat. No. 7,159,528 issued to Hiliker, U.S. Pat. No. 4,832,013 issued to Hartdorn and U.S. Pat. No. 5,924,416 issued to Miller disclose either electrically or gasoline engine powered air compressors that are capable of generating constant flow of compressible air to be used by the diver but that must be manually towed by the diver often fatiguing the diver's during towing effort. In U.S. Pat. No. 4,348,976 Gilbert improves the compressed air generating devices by adding a propulsion mechanism that allows the diver to be towed to a desired location. However, this device is only operable in one mode so that the diver has to select between towing and air generation.

Such mode of operation is inconvenient for many divers. In one aspect, difficulties arise in using Gilbert's device for towing purposes during high chop condition or rough seas, where the water can get into the snorkel tube and disrupt normal breathing. In another aspect, the diver being towed must remain above water surface at all times preventing such diver from enjoying underwater activities while being towed. Finally, when two divers are connected to the same device, both must be above the surface during towing.

Therefore, there is a need for an improved powered floating apparatus capable of simultaneously towing the diver and providing compressed air for underwater breathing.

SUMMARY OF THE INVENTION

In accordance with one aspect, the invention provides a floating apparatus operable for towing at least one diver and providing compressed air thereto for underwater breathing. The apparatus includes a water impermeable and buoyant hollow housing. The housing floats on a surface of a body of water. A power source is mounted on the housing. An air compressor is provided and is operable by the power source for generating the compressed air. A propulsion generating mechanism is also provided and is operable by at least one of the power source and the compressor for generating a propulsion force capable of moving the apparatus and towing such at least one diver. A control device is operatively coupled to the propulsion generating assembly. The control device is manually operable by the at least one diver for generating the propulsion force simultaneously with generation of the compressed air.

In accordance with another aspect of the present invention, there is provided a floating apparatus operable for towing divers and providing compressed air thereto for underwater breathing. The apparatus includes a water impermeable and buoyant hollow housing that floats on a surface of a body of water. The housing has each of a predetermined shape and a lower portion disposed below such surface. The housing is formed from a predetermined material. A mounting member is positioned relative to an exposed upper surface of the housing. Means is provided for attaching the mounting member to the exposed upper portion of the housing. A hollow tubular member is disposed generally vertical during operation of the apparatus. The hollow tubular member has an upper end thereof rigidly attached to a bottom surface of the mounting member and a lower end thereof positioned below such surface of such body of water. A hollow portion of the tubular member is aligned with an aperture formed through the mounting member. A handle member is secured to at least one of the housing and the hollow tubular member. An engine is rigidly mounted on an upper surface of the mounting member. The engine has a horizontally disposed rotating output shaft. The shaft has an exposed portion thereof extending outwardly from a housing of the engine and positioned above the mounting member. A driving pulley is medially mounted on the exposed portion of the output shaft for rotation therewith. An endless belt operatively engages the driving pulley and is at least partially disposed within the hollow portion of the tubular member. The endless belt is motionless, in absence of tension formed therein, relative to the driving pulley. A propeller assembly is mounted adjacent the lower end of the tubular member. The propeller assembly has a housing at least one of rigidly secured to and formed integral with the lower end. A propeller shaft is operatively mounted within the housing in a horizontal direction and has one end thereof extending into the hollow portion of the tubular member. A propeller is secured to an exposed opposite end of the propeller shaft for rotation therewith. A driven pulley is mounted on the one end of the propeller shaft and vertically aligned with the driving pulley, wherein the endless belt is operatively engageable with the driven pulley. There is means for forming the tension within the endless belt, the formed tension causing the endless belt to frictionally engage each of the driving and driven pulleys causing rotation of the driven pulley and enacting rotation of the propeller, the propeller rotation generating the propulsion force to move the apparatus in a forward direction and tow such at least one diver holding the handle member. An air compressor is mounted proximal to the extending portion of the output shaft of the engine for generating such compressed air. A flywheel is rotatably mounted on the extending portion of the output shaft adjacent a terminal end thereof. A drive link is also provided and has a first end thereof rotatably connected to the flywheel in spaced axial relationship to rotational axis of the output shaft and having an opposed second end thereof operatively connected to a piston assembly disposed within the air compressor enabling the air compressor to generate such compressed air during operation of the engine for such underwater breathing by such at least one diver. The present invention provides for such compressed air and the propulsion force being simultaneously generated during operation of the engine.

In accordance with yet another aspect, the present invention provides a floating apparatus for supplying pressurized air to at least one submerged diver and having a water impermeable and buoyant hollow housing that floats on a surface of a body of water, a power source mounted on the housing and a compressor operable by the power source for generating the pressurized air. In combination with such apparatus there is provided a self-propelled personal underwater propulsion device operable by the at least one submerged diver to be towed to a predetermined position on the body of water and means for detachably connecting the self-propelled personal underwater propulsion device below the surface of the body of water having the apparatus floating thereon.

In accordance with a further aspect of the invention, there is provided a novel apparatus for generating compressed air. The apparatus includes a casing having each of an outer wall, an inner wall, a first closed end, an opposed second closed end, and a chamber formed therewithin. A piston assembly is mounted for a reciprocal linear motion within the chamber. A piston rod is provided and has a first end thereof affixed to one end of the piston assembly and having an opposed end thereof extending through one of the first end and the second end. An air inlet is formed within the opposed one of the first end and the second end of the casing in air communication with the chamber. An inlet valve is mounted within the inlet port and operable for allowing air flow into the chamber when the piston assembly moves away from the opposed one of the first end and the second end of the casing. An air outlet is formed within the opposed one of the first end and the second end of the casing in air communication with the chamber. An outlet valve is mounted within the outlet port and operable for discharging air under pressure from the chamber when the piston assembly moves toward the opposed one of the first end and the second end of the casing. A fluid inlet is formed in one of the first end, the second end and a first portion of the outer wall of the casing in fluid communication with a space formed between the outer and inner walls. A fluid outlet is also formed in a second portion of the outer wall of the casing in fluid communication with the space formed between the outer and inner walls, whereby a predetermined fluid is allowed to circulate through the space by way of the fluid inlet and the fluid outlet for cooling the casing during the reciprocal motion of the piston assembly.

OBJECTS OF THE INVENTION

It is, therefore, one of the primary objects of the present invention to provide a powered floating diver tow and underwater breathing apparatus capable of simultaneously towing the diver and providing compressed air for underwater breathing.

Another object of the present invention is to provide a diver tow and underwater breathing apparatus that employs an air compressor and propulsion mechanism coupled to and operable by a gas-powered engine.

Yet another object of the present invention is to provide a diver tow and underwater breathing apparatus that can tow a submerged diver.

A further object of the present invention is to provide a diver tow and underwater breathing apparatus that is economical to manufacture.

Yet a further object of the present invention is to provide diver tow and underwater breathing apparatus that is simple to use.

An additional object of the present invention is to provide a water cooled air compressor employable within the diver tow and underwater breathing apparatus.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
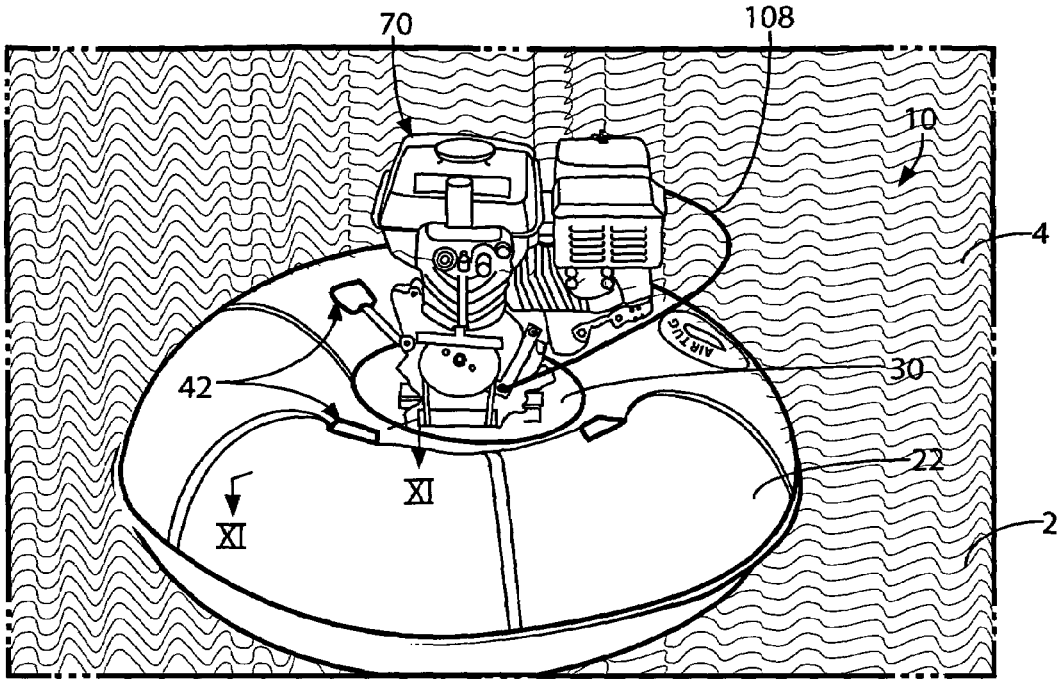
FIG. 1 is a front perspective view of a diver tow and underwater breathing apparatus of the present invention.
Figure 2:
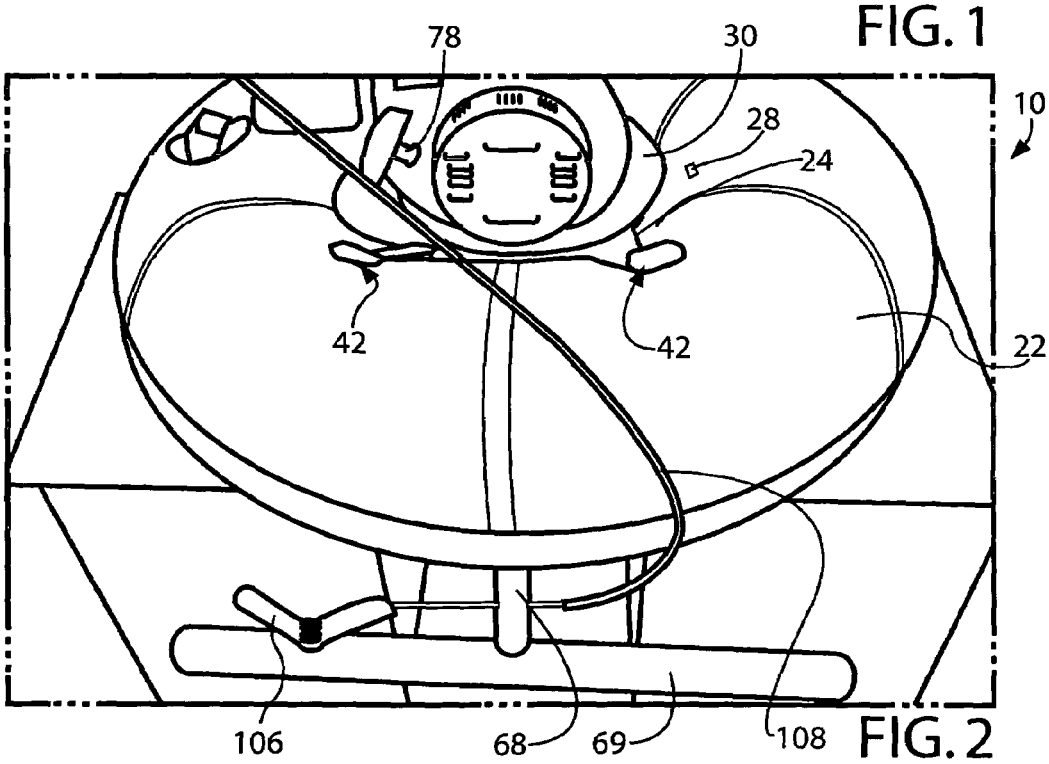
FIG. 2 is a partial rear perspective view of the apparatus of FIG. 1, particularly illustrating one end of a diver tow control assembly.
Figure 3:
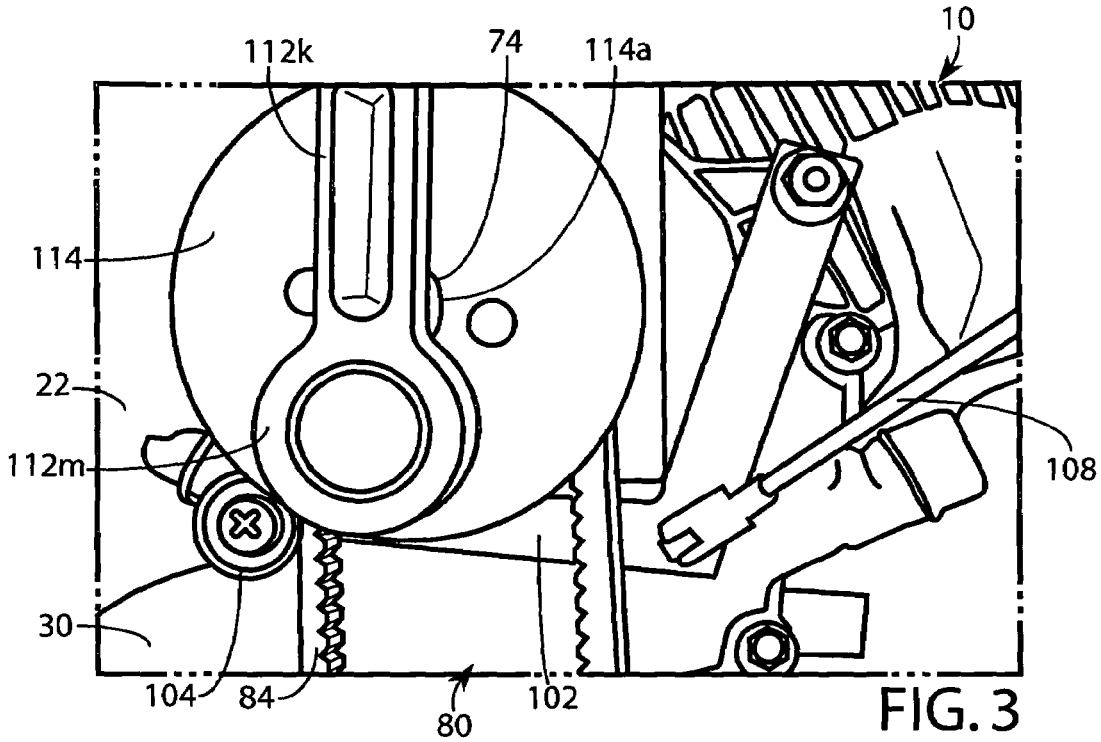
FIG. 3 is a partial front elevation view of the apparatus of FIG. 1, particularly illustrating an opposed end of the diver tow control assembly.
Figure 4:
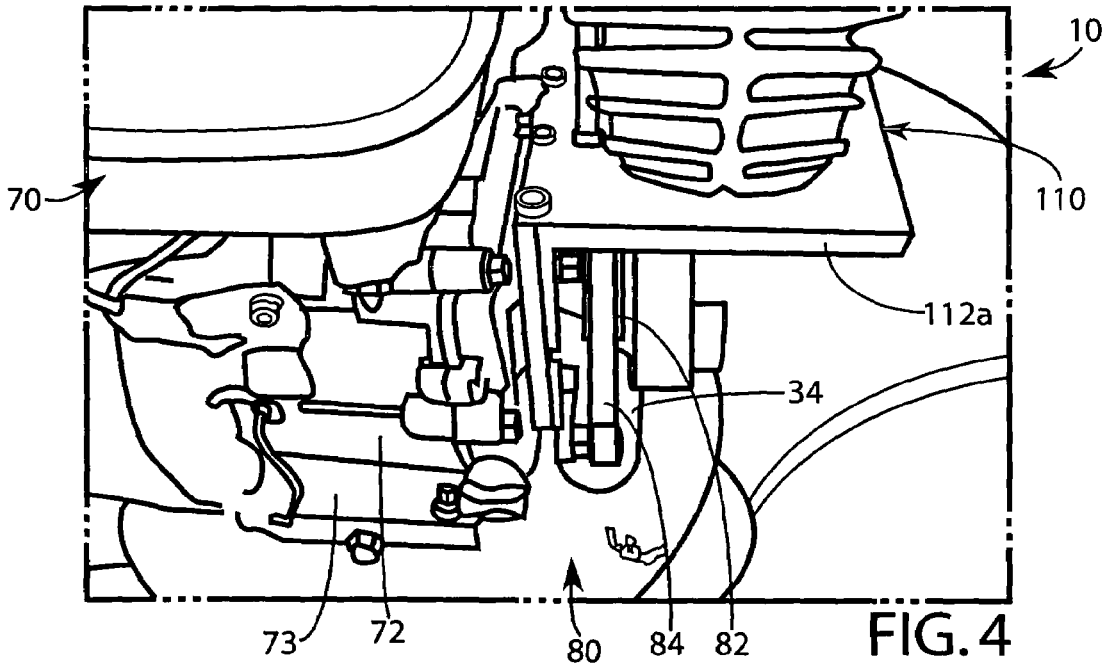
FIG. 4 is a partial side elevation view of the apparatus of FIG. 3.
Figure 5:
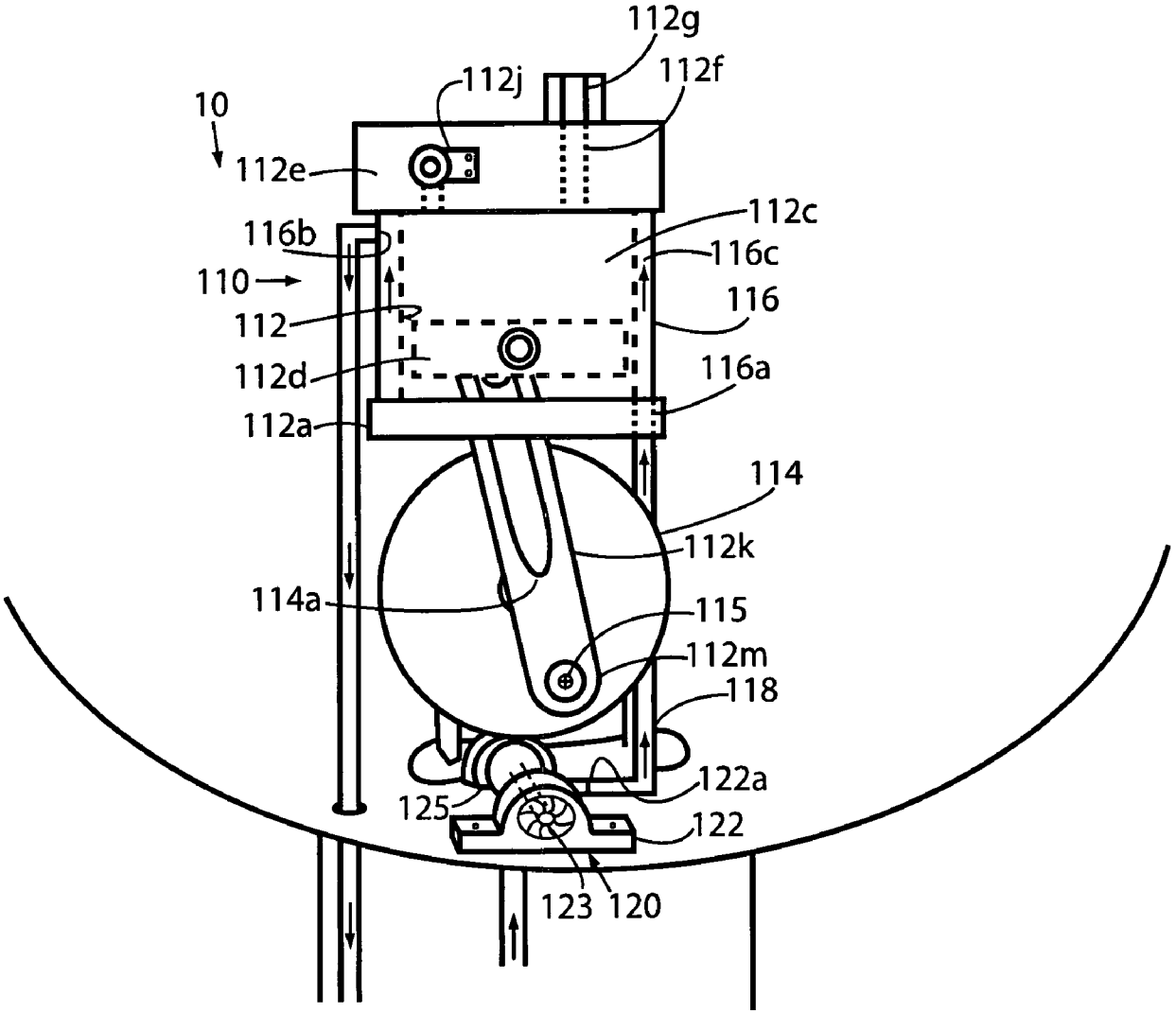
FIG. 5 is a front elevation view of an air compressor which is employed within the apparatus of FIG. 1 for generating compressed air for breathing purposes and which is constructed in accordance with a presently preferred embodiment of the invention.
Figure 6:
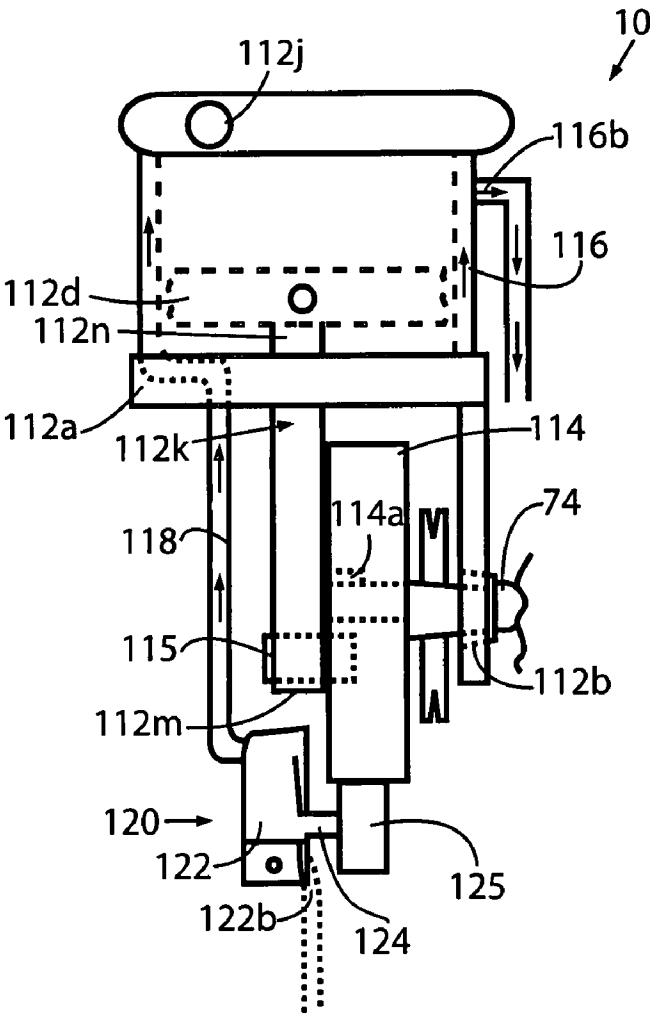
FIG. 6 is a side elevation view of the air compressor of FIG. 5.
Figure 7:
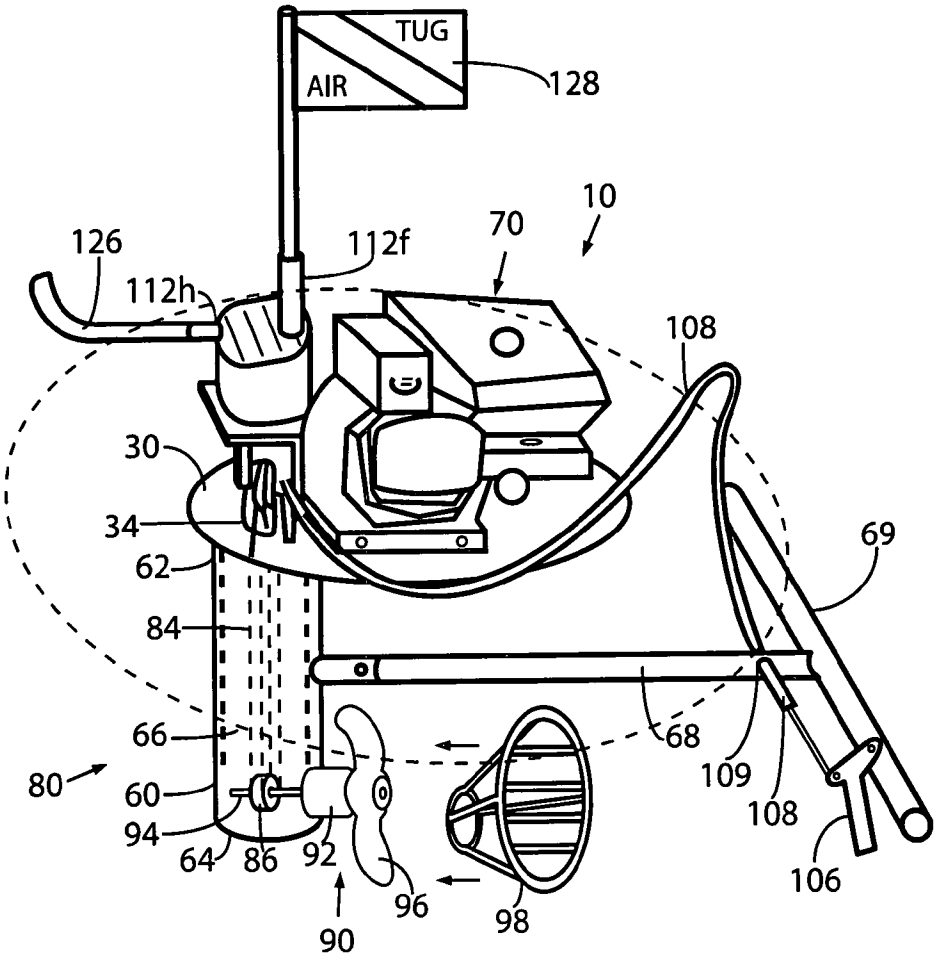
FIG. 7 is a side perspective view of the apparatus of FIG. 1, particularly illustrating a tow propulsion assembly which is constructed in accordance with one embodiment of the invention.

Prior to proceeding to the more detailed description of the present invention, it should be noted that, for the sake of clarity and understanding, identical components which have identical functions have been identified with identical reference numerals throughout the several views illustrated in the drawing figures.

The best mode for carrying out the invention is presented in terms of its various embodiment forms, herein depicted within FIGS. 1 through 11. However, the invention is not limited to the described embodiments, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

Reference is now made, to FIGS. 1-11, wherein there is shown a floating apparatus, generally designated as 10, which is operable for simultaneously towing divers and providing compressed air thereto. The floating apparatus 10 includes a water impermeable and buoyant hollow housing 22 that floats on a surface 4 of a body of water 2. The housing 22 has a predetermined shape. The presently preferred shape of the housing 22 is a conventional inflatable ring, although it will be apparent to those skilled in the relevant art that the present invention may be applied to other inflatable or non-inflatable flotation devices and as such should not be interpreted as a limiting factor of the flotation device 10 of the present invention. The hollow housing 22 has a circular circumference and a central circular aperture 24 formed therethrough. The housing 22 also has a generally circular vertical cross-section throughout. As is conventionally known, the hollow housing 22 may be equipped with a valve 28 operatively mounted within a wall portion thereof for enabling selective inflation and deflation of such hollow housing 22. As is also conventional, the upper portion of the housing 22 is exposed above the water surface 4 while a lower portion of the housing 22 is generally hidden from direct view below such water surface 4. The housing 22 is formed from a predetermined material which may be at least one of canvas, plastic, fiberglass and like water impermeable materials.

A mounting member 30 is provided and is positioned relative to an exposed upper surface of the housing 22. When the housing 22 has a ring shape, the mounting member 30 is preferably provided as a disk-like, plate-like member having a round shape and positioned within the housing 22 and above the horizontal center plane thereof.

Means is provided for attaching the mounting member 30 to the exposed upper portion of the housing 22. Generally, such mounting means depends on the material and construction of the housing 22. By way of an example of FIGS. 1-2 and 11, when the housing 22 is provided as an inflatable ring, such attachment means includes a predetermined plurality of anchor members 42 secured to the exposed upper portion. Furthermore, such anchor members 42 are provided as having base portion 44 sewn or glued to the surface of the housing 22 and a hollow tubular portion 46 extending therefrom. An aperture 48 is formed through a wall of the hollow tubular portion 46. There is also a predetermined plurality of first apertures 32 formed through the mounting member 30, each of the predetermined plurality of apertures 32 being aligned with a respective anchor member 42 and, more particularly, aligned with the aperture 48. A predetermined plurality of T-shaped strap members 50 are also provided. Each of the predetermined plurality of strap members 50 has a first end 52 thereof securely received within the hollow tubular portion 46 of the respective anchor member 42 and having a second end 54 thereof engageable with a surface of the mounting member 30 adjacent a respective first aperture 32 formed therethrough. A second aperture 56 is formed in the second end 54 of the each strap member and aligned with the respective first aperture 32. A threaded male fastener 58 is passed through aligned first and second apertures 32, 56 and a threaded female fastener 59 operatively engages a threaded end of a respective threaded male 58 for securing the second end 54 of the strap 50 to the mounting member 30.

In a particular reference, the mounting member may be provided with a peripheral flange 34 which is inclined at an angle or curved to generally correspond to the curvature of the housing 22. A strap member 38 is secured to the peripheral flange 34 and is wrapped around the surface portion of the housing 22. The strap member 38 is then simply secured by a conventional strap lock, clasp or buckle 39. The strap member 38 may be secured to the exterior surface of the peripheral flange 34 by way of adhesive or fasteners (not shown) or tandems of spaced apart elongated slots 36 may be formed through the peripheral flange 34 so that each strap member 38 can be simply passed through a respective tandem of slots 36.

The apparatus 10 further includes a hollow tubular member 60 having an upper end 62 thereof rigidly attached to a bottom surface of the mounting member 30 and a lower end 64 thereof positioned below such surface 4 of such body of water 2. The hollow tubular member is vertically disposed when the apparatus 10 is operatively placed onto the water surface 4, wherein an internal hollow portion 66 of the tubular member 60 is aligned with an aperture 34 formed through the mounting member 30.

Figure 8:
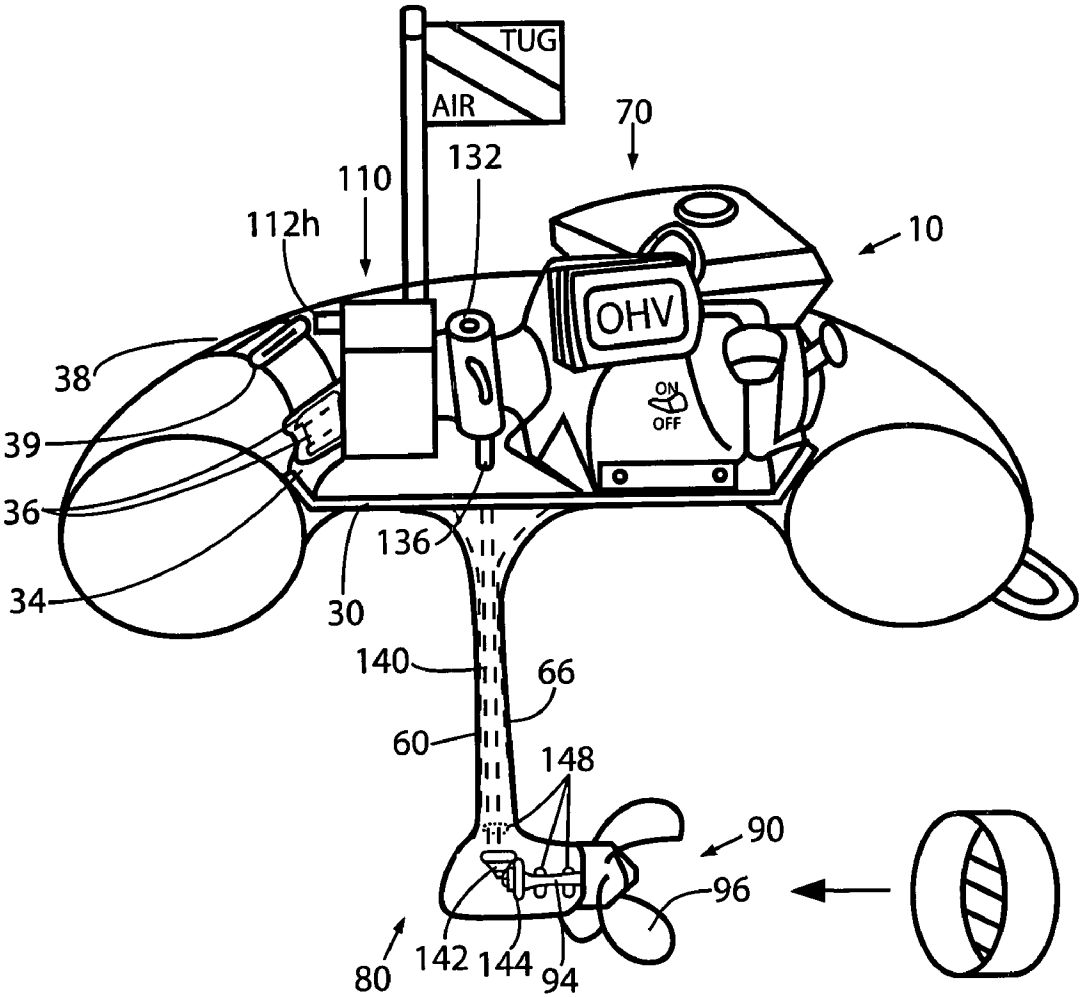
FIG. 8 is a side perspective view of the apparatus of FIG. 1, particularly illustrating a tow propulsion assembly which is constructed in accordance with another embodiment of the invention.
Figure 9:
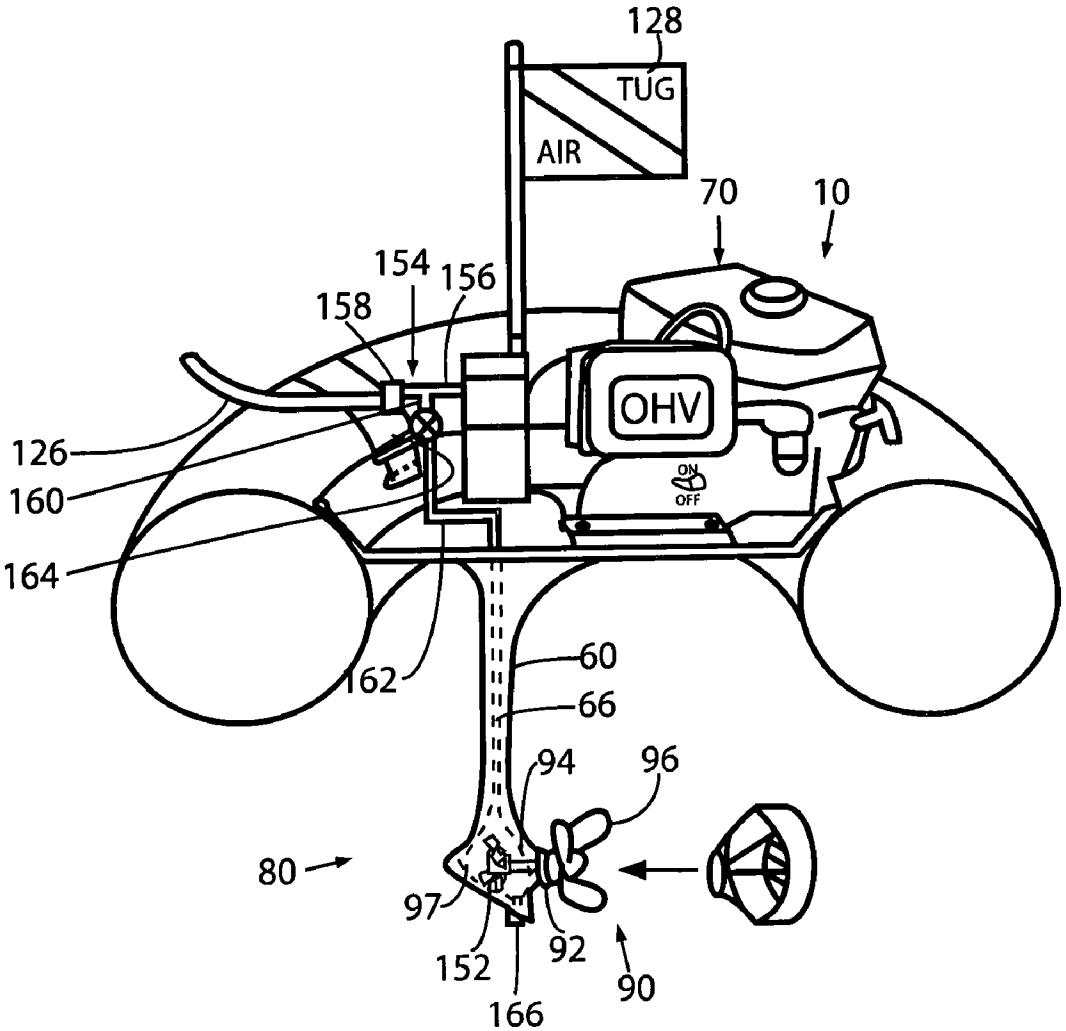
FIG. 9 is a side perspective view of the apparatus of FIG. 1, particularly illustrating a tow propulsion assembly which is constructed in accordance with yet another embodiment of the invention.
Figure 10:
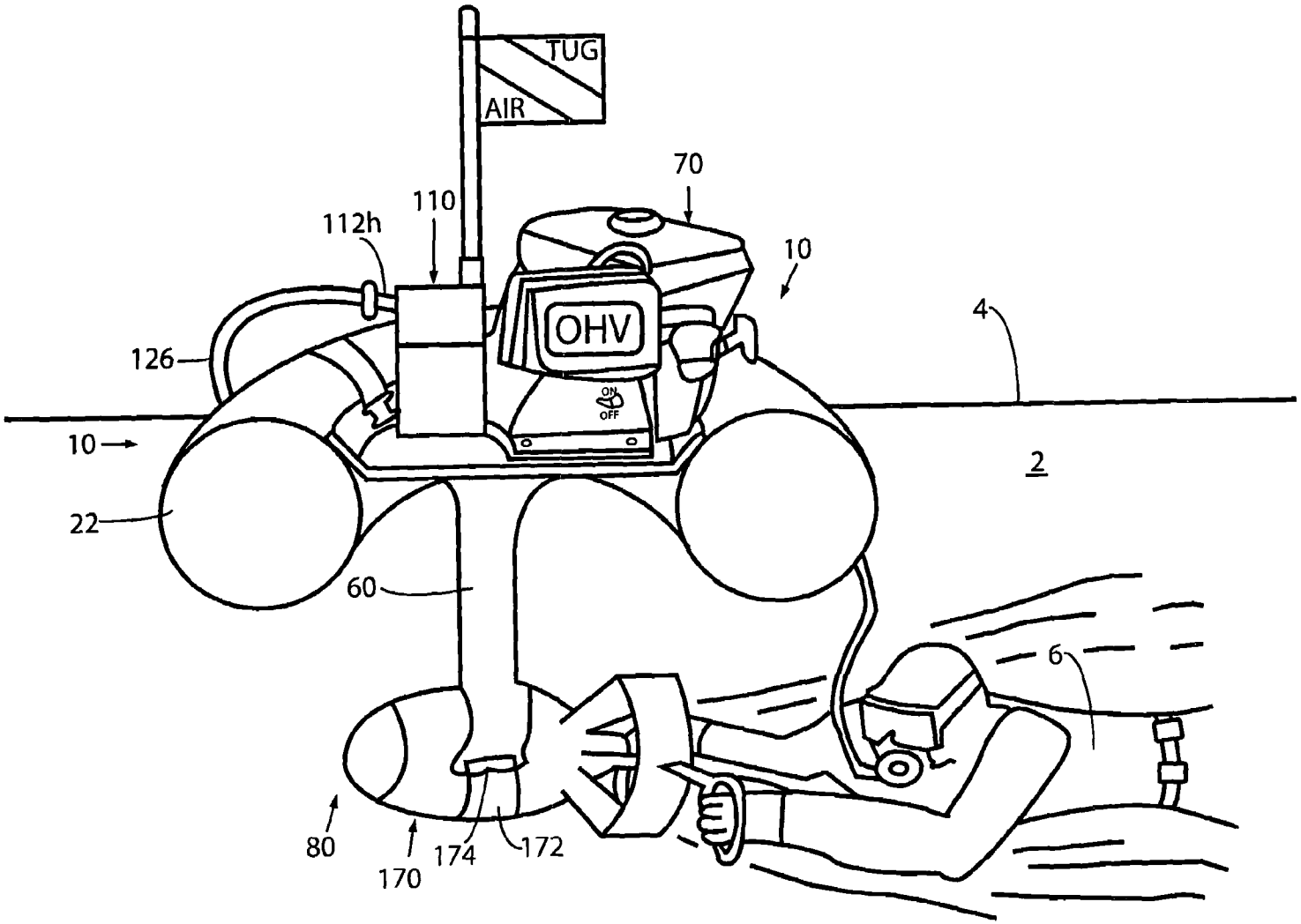
FIG. 10 is a side perspective view of the apparatus of FIG. 1, particularly illustrating a tow propulsion assembly which is constructed in accordance with a further embodiment of the invention.
Figure 11:
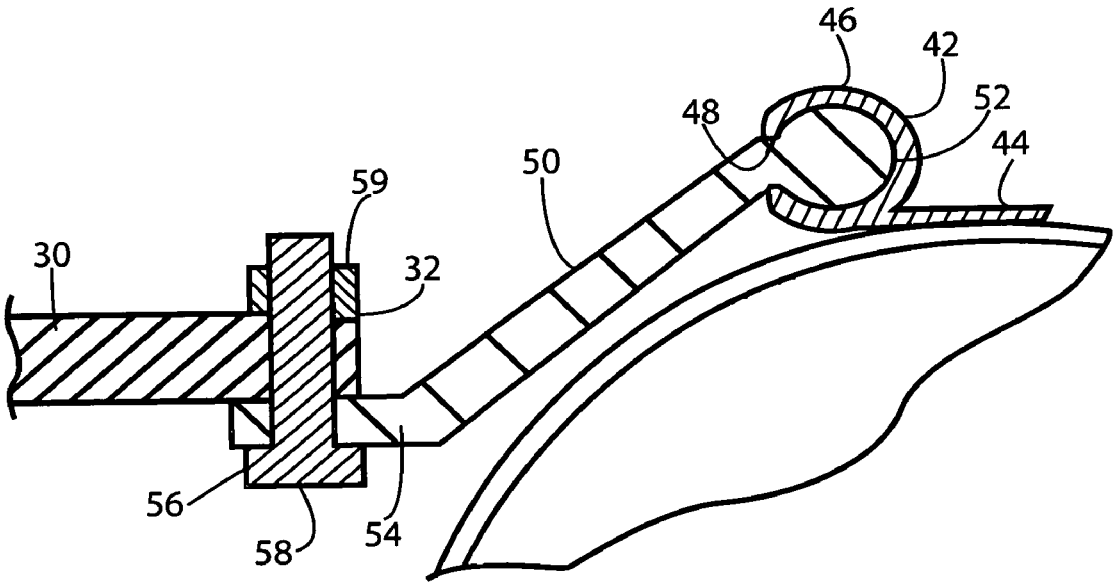
FIG. 11 is a partial cross-sectional elevation view of the apparatus along lines 11-11 of FIG. 1, particularly illustrating means for attaching the various components to a buoyant body.

Another required element of the present invention is a handle member 68 that can be secured to the housing 22 and is preferably rigidly secured to the exterior surface of the hollow tubular member 60. The handle member 68 has a handle bar portion 69 extending beyond the periphery of the housing 22, as best shown in FIGS. 8-9, so that the diver 6 can easily and conveniently grasp the handle bar 69 for towing purposes. Preferably, at least the handle bar 69 is disposed below the surface 4 so that the diver 6 being towed can remain below the surface 4, as best shown in FIG. 10.

A power source is mounted on the upper surface of the mounting member 30. In accordance with a presently preferred embodiment of the invention, such power source is a conventional small gas-powered internal combustion engine 70 of the type that can be found, for example, on lawn moving machines. The engine 70 has a horizontally disposed rotating output shaft. The output shaft has an exposed portion 74 thereof extending outwardly from a housing 72 of the engine 70 and is preferably positioned above the mounting member 30. The housing 72 is fastened to the mounting member 30 at the flanges 73. In a conventional manner, the engine 70 has a pull start cord and a handle assembly 78.

In order to generate compressed air, the apparatus 10 includes an air compressor means capable of generating compressed air. Such air compressor mean may be of any conventional type, for example such as a piston-type air compressor manufactured by Gast Manufacturing, Inc Benton Harbor, MI under PCA-10 brand. However, the present invention provides a novel compressor means, generally designated as 110, for generating such compressed air. Now in further reference to FIGS. 5-6, such compressor means 110 includes a cylinder 112. The cylinder 112 preferably has a casing of a circular cross-section. A first end 112*a* of the cylinder 112 is provided as an L-shape member, so that the vertical portion of such L-shape end 112*a* is secured to the housing 72 of the engine 70. An aperture 112*b* is provided within the vertical portion of the L-shape end 112*a* for enabling passage of the exposed shaft portion 74 therethrough. A piston assembly 112*d* is mounted for linear reciprocal motion within the interior chamber 112*c* of the cylinder 112. An air inlet port 112*f* is formed within the opposed end 112*e* of the cylinder 112 in air communication with the interior chamber 112*c*. An inlet valve 112*g* is mounted within the inlet port 112*f* and operable for allowing air flow into the interior chamber 112*c* when the piston assembly 112*d* moves away from the opposed end 112*e* of the cylinder 112. An air outlet port 112*h* is also formed within the opposed second end 112*e* in air communication with the interior chamber 112*c*. An outlet valve 112*j* is mounted within the outlet port 112*h* and opens for discharging air under pressure (compressed air) from the interior chamber 112*c* when the piston assembly 112*d* moves toward the opposed end 112*e*. The inlet valve 112*f* and outlet valve 112*j* are of a conventional spring-loaded type operable due to the pressure differential created by movement of the piston assembly 112*d*.

A disk-like flywheel 114 is rotatably mounted on the extending portion 74 of the output shaft adjacent a terminal end thereof. By way of an example only of FIGS. 4-6, the flywheel 114 may be secured by a key arrangement 114*a*. A piston rod 112*k* is provided and has a first end 112*m* thereof rotatably connected to the flywheel 114, for example by way of a shoulder screw 115, in axial spaced relationship relative to the axis of the output shaft portion 74. The piston rod 112*k* also has an opposed second end 112*n* thereof pivotally connected to one end of the piston assembly 112*c*. Thus, rotational movement of the flywheel 114 generates linear reciprocal motion of the piston assembly 112*d* enabling the air compressor 110 to generate such compressed air during operation of the engine 70 for such underwater breathing by such diver 6. Advantageously, the compressor means 110 is mounted to the side of the engine housing 72 having a fan (not shown) mounted therein for air cooling the cylinder 112 thereby.

In a conventional manner, the outlet port 112*h* is operable for supplying compressed air to diver by way of tube 126. Also in a conventional manner, a diver's flag 128 is provided and may be connected to the inlet port 112*f* of the cylinder 112.

It is also within the scope of the present invention to provide a novel water cooled compressor means 110. Now, in further reference to FIGS. 5-6, the compressor means 110 includes a cylinder 116 which concentrically receives the cylinder 112 therewithin. Thus, the cylinder 112 now becomes an inner cylinder and the cylinder 116 becomes an outer cylinder forming a peripheral space 116*c* between the inner and outer walls. Further, a fluid inlet 116*a* is formed in a first end 112*a* in fluid communication with the space 116*c* formed between the outer and inner walls. A fluid outlet 116*b* is formed in a second portion of the outer wall of the cylinder 116 in fluid communication with the space 116*c* formed between the outer and inner walls, whereby a predetermined fluid circulates through the space 116*c* by way of the fluid inlet 116*a* and the fluid outlet 116*b* for cooling the compressor 110 during the reciprocal movement of the piston assembly 112*d* and generation of the compressed air.

In order to circulate the fluid, which is in this invention is a sea water, through the space 116*c* formed between the cylinders 112 and 116, the apparatus 10 includes a water pump which is connected to the inlet 116*a* by way of a tubing 118. Any conventional water pump capable of circulating sea water can be employed in the present invention. However, it is presently preferred to provide a pump 120 which includes a housing 122 having a fluid outlet 122*a* and a fluid inlet 122*b* formed therewith. An impeller 123 is rotatably mounted within the housing 122 and has a shaft portion 124 thereof extending through the housing 122. A disk-like member 125 is secured to a free end of the shaft portion 124 for rotation therewith. Such disk-like member 125 is preferably formed from an elastomeric material, such as rubber, and has a peripheral edge thereof frictionally abutting a peripheral edge of the flywheel 114. In operation, the rotation of the flywheel 114 causes rotation of the disk-like member 125 and causes the impeller 123 to circulate the sea water through the space between the outer and inner walls.

While the air cooled compressor means 110 have been found to be adequate in generating compressed air, the water cooled compressor means 110 provides for improved cooling of the cylinder 112 as the water temperature are generally cooler than the air temperatures or the temperature exhausted by the ventilation fan (not shown) of the engine 70.

The apparatus 10 of the present invention also includes a propulsion generating means, generally designated as 80. In accordance with a presently preferred embodiment of the invention, such propulsion generating means 80 includes a driving pulley 82 which is medially mounted on the exposed portion 74 of the output shaft for rotation therewith. An endless belt 84 is operatively engageable with the driving pulley 82 and at least partially disposed within the hollow portion 66 of the tubular member 60. The endless belt 84 is motionless, in absence of tension formed therein, relative to the driving pulley 82. A propeller means, generally designated as 90, is positioned adjacent the lower end 64 of the tubular member 60. The propeller means 90 has a housing 92 at least one of rigidly secured to and formed integral with the lower end 64. A propeller shaft 94 is operatively mounted within the housing 92 and in a horizontal direction and has one end thereof extending into the hollow portion 66 of the tubular member 60. A propeller 96 is secured to an exposed opposite end of the propeller shaft 94 for rotation therewith. The propeller 96 may be enclosed within an optional guard housing 98 for preventing injuries to the diver 6 being towed behind the propeller 96. A driven pulley 86 is mounted on the one end of the propeller shaft 94 and vertically aligned with the driving pulley 82, wherein the endless belt 84 is operatively engageable with the driven pulley 86.

In a breathing only operating mode, the endless belt 84 is absent of any tension so that the driving pulley 82 is allowed to rotate without causing movement of the endless belt 84 and without causing rotation of the driven pulley 86. Thus, the diver 6 benefits from supply of compressed air for breathing purposes without concern for movement of the apparatus 10.

To operate the apparatus 10 in a towing mode, such apparatus 10 further includes means for forming tension within the endless belt 84. Such tension causes the endless belt 84 to frictionally engage each of the driving pulley 82 and the driven pulley 86, and causes rotation of the propeller 96. It will be appreciated that rotation of the propeller 96 generates propulsion force to move the apparatus 10 in a forward direction and tow such diver 6 holding onto the handle bar portion 69. In accordance with a presently preferred embodiment of the invention, such tension forming means includes a first lever 102 which is pivotally attached to one of the engine 70 and the mounting member 30. A roller 104 is rotatably affixed on one end of the first lever 102 and has a side surface thereof engaging a portion of the endless belt 84. A second lever 106 is affixed on the handle member 68, preferable on or in a close proximity to the handle bar 69. A link 108 is provided and has a first end thereof connected to the first lever 102 and has an opposed second end thereof connected to the second lever 106. The presently preferred link 108 is a well known Bowden-type cable. One end of the cable is routed through an aperture 109 formed in the handle member 68 for support purposes during operation. With the Bowden-style cable, the second lever 106 is pivotally affixed, so that its rotation, manually achieved by the diver 6, in one direction causes rotation of the first lever 102 enabling the roller 104 to engage the portion of the endless belt 84 and apply force thereonto thus forming tension therewithin. When the diver 6 rotates the second lever 106 in an opposed direction, the roller 104 disengages the portion of the endless belt 84 thus discontinuing tension therewithin. When the tension is discontinued, propeller 96 ceases its rotation.

Thus, the criticality of connecting the air compressor 110 and the propulsion generating means 80 to the exposed portion 74 of the output shaft of the engine 70 is in that the compressed air and the propulsion force are capable of being simultaneously generated during operation of the engine 70. Thus, the diver 6 being towed can remain submerged under the surface 4 of the body of water 2 aided by supply of compressed breathing air from the air compressor means 110 for enjoying underwater activities or avoiding undesirable waves. The simultaneous supply of compressed air and available propulsion force enable one diver to remain submerged while another diver is being towed by the apparatus 10 and controls the travel direction thereof.

It is also within the scope of the present invention to provide other forms of the propulsion means 80. Now in a particular reference to FIG. 8, there is illustrated a first alternative embodiment of the propulsion means 80 that includes a gearbox 132 operatively coupled intermediate the compressor means 110 and the power source 70. The gearbox 132 has a pair of output shafts, whereby the air compressor means 110 is connected to one of the pair of output shafts of the gearbox 132. A drive shaft 140 is disposed within a hollow portion 66 of the elongated member 60 and operatively coupled at one end thereof to on opposed output shaft 136 of the gearbox 132. A first beveled gear 142 is affixed to an opposed end of the drive shaft 140 for rotation therewith. A second beveled gear 144 is affixed to the one end of the propeller shaft 94 for rotation therewith. The second beveled gear 144 is operatively meshing with the first beveled gear 142. A predetermined plurality of bearings 148 is provided for operatively mounting each of the drive shaft 142 and the propeller shaft 94.

Now in reference to FIG. 9, there is illustrated a second alternative embodiment of the propulsion means 80 that includes a chamber 97 formed within the lower end 64 of the elongated member 60 in air communication with the hollow portion 66 which is adapted to function as an air passageway. A turbine wheel 152 is secured on the one end of the propeller shaft 94 for rotation therewith and is aligned with the passageway 66. An air directional member 154 is provided and has an inlet port 156 thereof attached to an outlet port 112*h* of the compressor 110. The diver air supply tubing 126 is connected to a first outlet port 158 of the air directional member 154. An air supply member 162 connects a second outlet port 160 of the air directional member 154 and the passageway 66. A control valve 164 is operatively disposed within the air supply member 162. The control valve 164 is selectively operable by such diver 6 to selectively supply such compressed air to the passageway 66, whereby the compressed air supply causes rotation of the turbine wheel 152 and subsequently causes rotation of the propeller 96 to generate a propulsion force and tow such driver simultaneously with supplying such compressed air to such diver. A vent means 166 is also provided on the lower end 64 of the elongated member 60 in air communication with the chamber 67 for venting the compressed air supply external thereto.

Now in reference to FIG. 10, there is illustrated a third alternative embodiment of the propulsion means 80 that includes a self-propelled personal underwater propulsion device 170 guidable by the at least one submerged diver 6 to be towed to a predetermined position on the body of water 4. Such self-propelled personal underwater propulsion device 170 may be of a type as manufactured by scooter motion under a Sea Doo brand. There is also means for detachably connecting the self-propelled personal underwater propulsion device 170 below the surface 6 of the body of water 4 having the apparatus 10 floating thereon. Such detachably connecting means includes a strap means 172 secured to the lower end 64 of the rigid elongated member 60 and has a lock member 174 for detachably securing the strap member 172 around the peripheral surface of the self-propelled personal underwater propulsion device 170. Thus the diver 6 can use the propulsion force generated by the self-propelled personal underwater propulsion device 170 to be towed to a desired location. When arrived at such predetermined location, the diver 6 disconnects the self-propelled personal underwater propulsion device 170 from the apparatus 10 by unlocking the strap lock 174. The diver 6 can now use the self-propelled personal underwater propulsion device 170 for diving purposes. When finished, the diver 6 reconnects the self-propelled personal underwater propulsion device 170 to the apparatus 10 for towing purposes.

Although the present invention has been shown in terms of the apparatus 10 employing a gas-powered internal combustion engine, it will be apparent to those skilled in the art, that the apparatus 10 of the present invention may be constructed with an electrical operated source, for example such as combination of an electric motor and a battery for operating the electric motor.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. A floating apparatus operable for towing at least one diver and providing compressed air thereto for underwater breathing, said apparatus comprising:

(a) a water impermeable and buoyant hollow housing that floats on a surface of a body of water;

(b) a power source mounted on said housing above the surface of the body of water, wherein said power source is an internal combustion engine having a portion of a rotating output shaft extending outwardly from a housing of said internal combustion engine, whereby each of said compressor means and said propulsion generating means are coupled to said exposed portion of said rotating output shaft;

(c) a compressor means operable by said power source for generating such compressed air; and (d) a propulsion generating means operable by at least one of said power source and said compressor for generating a propulsion force capable of moving said apparatus and towing such at least one diver.

2. A floating apparatus operable for towing at least one diver and providing compressed air thereto for underwater breathing, said apparatus comprising:

(a) a water impermeable and buoyant hollow housing that floats on a surface of a body of water, said housing having a lower portion disposed below such surface;

(b) a mounting member positioned relative to an exposed upper surface of said housing;

(c) means for attaching said mounting member to said exposed upper portion of said housing;

(d) a hollow tubular member disposed generally vertical during operation of said apparatus, said hollow tubular member having an upper end thereof rigidly attached to a bottom surface of said mounting member and a lower end thereof positioned below such surface of such body of water, wherein a hollow portion of said tubular member is aligned with an aperture formed through said mounting member;

(e) a handle member secured to at least one of said housing and said hollow tubular member;

(f) an engine rigidly mounted on an upper surface of said mounting member, said engine having a horizontally disposed rotating output shaft, said shaft having an exposed portion thereof extending outwardly from a housing of said engine and positioned above said mounting member;

(g) a driving pulley mounted on said exposed portion of said output shaft for rotation therewith;

(h) an endless belt engageable with said driving pulley and at least partially disposed within said hollow portion of said tubular member;

(i) a propeller means positioned adjacent said lower end of said tubular member, said propeller means having a housing at least one of rigidly secured to and formed integral with said lower end, a propeller shaft mounted within said housing in a horizontal direction and having one end thereof extending into said hollow portion of said tubular member, and a propeller secured to an exposed opposite end of said propeller shaft for rotation therewith;

(j) a driven pulley mounted on said one end of said propeller shaft and vertically aligned with said driving pulley, wherein said endless belt is engageable with said driven pulley;

(k) means for forming tension within said endless belt causing rotation of said driven pulley and enacting rotation of said propeller, said propeller rotation generating said propulsion force to move said apparatus in a forward direction and tow such at least one diver holding said handle member;

(l) an air compressor means mounted proximal to said extending portion of said output shaft of said engine for generating such compressed air;

(m) a flywheel rotatably mounted on said extending portion of said output shaft adjacent a terminal end thereof; and (n) a drive link having a first end thereof rotatably connected to said flywheel in spaced axial relationship to rotational axis of said output shaft and having an opposed second end thereof connected to a piston assembly disposed within said air compressor means enabling said air compressor means to generate such compressed air during operation of said engine for such underwater breathing by such at least one diver.

3. The apparatus, according to claim 2, wherein said means for attaching said mounting member to said exposed upper portion of said housing includes:

(a) a predetermined plurality of anchor members secured to said exposed upper portion;

(b) a predetermined plurality of first apertures formed through said mounting member, each of said predetermined plurality of apertures aligned with a respective anchor member;

(c) a predetermined plurality of strap members, each of said predetermined plurality of strap members having a first end thereof securely received within said respective anchor member and having a second end thereof engageable with a surface of said mounting member adjacent a respective first aperture formed therethrough;

(d) a second aperture formed in said second end of said each strap member and aligned with said respective first aperture; and (e) a predetermined plurality of threaded male fasteners, each of said predetermined plurality of threaded male fasteners passed through aligned first and second apertures and a predetermined plurality of threaded female fasteners, each of said predetermined plurality of threaded female fasteners engaging a threaded end of a respective threaded male for securing said second end of said strap to said mounting member.

4. The apparatus, according to claim 2, wherein said tension forming means includes:

(a) a first lever pivotally attached to one of said engine and said mounting member;

(b) a roller rotatably affixed on one end of said first lever and having a side surface thereof engaging a portion of said endless belt;

(c) a second lever rotatably affixed on said handle member;

(d) a link having a first end thereof connected to said first lever and having an opposed second end thereof connected to said second lever, whereby manual rotation of said second lever by such at least one diver rotates said one end of said first lever causing said roller to apply force onto said endless belt and to form said tension therewithin.

5. The apparatus, according to claim 2, wherein said apparatus includes a guard member attached to one of said lower end of said hollow tubular member and said propeller housing for enclosing said propeller therewithin.

6. In combination with a floating apparatus for supplying pressurized air to at least one submerged diver and having a water impermeable and buoyant hollow housing that floats on a surface of a body of water, a power source mounted on said housing and a compressor operable by said power source for generating said pressurized air, an improvement comprising;

(a) a self-propelled personal underwater propulsion device; and (b) means for detachably connecting said self-propelled personal underwater propulsion device to said housing below said surface of said body of water having said apparatus floating thereon, wherein said detachably connecting means includes:

i. a rigid member secured at one end thereof to at least one of said housing and a mounting member having said power source mounted thereon, and ii. a strap means secured to an opposed end of said rigid member and having a lock member for detachably securing said strap member around the peripheral surface of said self-propelled personal underwater propulsion device.

7. A floating apparatus operable for towing at least one diver and providing compressed air thereto for underwater breathing, said apparatus comprising:

(a) a water impermeable and buoyant hollow housing that floats on a surface of a body of water;

(b) a power source mounted on said housing above the surface of the body of water;

(c) a compressor means operable by said power source for generating such compressed air; and (d) a propulsion generating means operable by at least one of said power source and said compressor for generating a propulsion force capable of moving said apparatus and towing such at least one diver, said propulsion generating means includes:

i. a gearbox disposed between said compressor means and said power source, said gearbox having a pair of output shafts, whereby said compressor is connected to one of said pair of output shafts of said gearbox, ii. an elongated hollow member extending outwardly from said housing and disposed below such surface of such body of water during operation of said apparatus, iii. a drive shaft disposed within a hollow portion of said elongated member and coupled at one end thereof to another one of said pair of output shafts, iv. a first beveled gear affixed to an opposed end of said drive shaft for rotation therewith, v. a propeller means positioned adjacent a lower end of said elongated member, said propeller means having a housing at least one of rigidly secured to and formed integral with said lower end, a propeller shaft mounted within said housing in a horizontal direction and having one end thereof extending into said hollow portion of said elongated member, and a propeller secured to an exposed opposite end of said propeller shaft for rotation therewith, vi. a second beveled gear affixed to said one end of said propeller shaft for rotation therewith, said second beveled gear meshing with said first beveled gear, and vii. a predetermined plurality of bearings for mounting each of said drive shaft and said propeller shaft.

8. A floating apparatus operable for towing at least one diver and providing compressed air thereto for underwater breathing, said apparatus comprising:

(a) a water impermeable and buoyant hollow housing that floats on a surface of a body of water;

(b) a power source mounted on said housing above the surface of the body of water;

(c) a compressor means operable by said power source for generating such compressed air; and (d) a propulsion generating means operable by at least one of said power source and said compressor for generating a propulsion force capable of moving said apparatus and towing such at least one diver, said propulsion generating means includes:

i. an elongated member extending outwardly from said housing and disposed below such surface of such body of water during operation of said apparatus, ii. a chamber formed within a lower end of said elongated member;

iii. a passageway provided within said elongated member in air communication with said chamber and in open communication with an upper end of said elongated member, iv. a propeller means positioned adjacent said lower end of said elongated member, said propeller means having a housing at least one of rigidly secured to and formed integral with said lower end, a propeller shaft mounted within said housing in a horizontal direction and having one end thereof extending into said chamber of said elongated member, and a propeller secured to an exposed opposite end of said propeller shaft for rotation therewith;

v. a turbine wheel secured on said one end of said propeller shaft for rotation therewith and aligned with said passageway, vi. an air directional member having an inlet port thereof attached to an outlet of said compressor, whereby a diver air supply tubing is connected to a first outlet port of said air directional member, vii. an air supply member connecting a second outlet port of said air directional member and said passageway, viii. a control valve disposed within said air supply member, said control valve is selectively operable by such at least one diver to selectively supply such compressed air to said passageway, whereby said compressed air supply causes rotation of said turbine wheel and subsequently causes rotation of said propeller to generate said propulsion force and tow such at least one diver simultaneously with supplying such compressed air thereto, and ix. a vent means in air communication with said chamber for venting said compressed air supply external thereto.

* * * * *